US011524817B2

(12) United States Patent
Zhang et al.

(10) Patent No.: US 11,524,817 B2
(45) Date of Patent: Dec. 13, 2022

(54) SEALED PACKAGING CONTAINER

(71) Applicant: Meiyang Plastic Metals Products Co., Ltd. Quanzhou, Fujian (CN)

(72) Inventors: Dongyang Zhang, Fujian (CN); Xiaojie Cai, Fujian (CN); Cangyang Cai, Fujian (CN); Yuexin Zhuang, Fujian (CN)

( * ) Notice: Subject to any disclaimer, the term of this patent is extended or adjusted under 35 U.S.C. 154(b) by 100 days.

(21) Appl. No.: 17/058,685

(22) PCT Filed: Dec. 3, 2018

(86) PCT No.: PCT/CN2018/118966
§ 371 (c)(1),
(2) Date: Nov. 25, 2020

(87) PCT Pub. No.: WO2019/237680
PCT Pub. Date: Dec. 19, 2019

(65) Prior Publication Data

US 2021/0206540 A1 Jul. 8, 2021

(30) Foreign Application Priority Data

Jun. 15, 2018 (CN) ..... 201820929736.0

(51) Int. Cl.
*B65D 43/06* (2006.01)

(52) U.S. Cl.
CPC .... *B65D 43/065* (2013.01); *B65D 2543/0049* (2013.01); *B65D 2543/00537* (2013.01); *B65D 2543/00555* (2013.01)

(58) Field of Classification Search
CPC .. B65D 43/065; B65D 43/06; B65D 43/0212; B65D 43/0208; B65D 43/0204; B65D 43/02
USPC ..... 220/783, 780, 797, 796, 270, 276, 266, 220/265
See application file for complete search history.

(56) References Cited

U.S. PATENT DOCUMENTS 3,817,420 A * 6/1974 Heisler ..... B65D 43/0208 220/276
4,180,179 A * 12/1979 Hoenig ..... B65D 43/0206 220/784
4,449,641 A * 5/1984 Jorgensen ..... B65D 43/0206 220/270
4,819,842 A * 4/1989 Westervelt ..... B05C 17/001 222/394

(Continued)

*Primary Examiner* — Robert J Hicks
(74) *Attorney, Agent, or Firm* — Prakash Nama; Global IP Services, PLLC

(57) ABSTRACT

A novel sealed packaging container, comprising a container cover (1) and an open container body (2), wherein an edge of the container cover and a mouth edge of the container body are correspondingly provided with a first inner matching groove (11) and second outer matching groove (21), and a first outer matching groove (12) and second outer matching groove (22) having a double-folded structure; and the container is further provided with an anti-unfastening structure. An outer groove wall of the second outer matching groove extends downward from an upper end portion and is provided with two indentations (2231) that are easy to tear. The packaging container has strong anti-deformation abilities, the anti-unfastening structure is relatively stable, and the sealing performance is good.

6 Claims, 12 Drawing Sheets

(56) References Cited

U.S. PATENT DOCUMENTS

| | | | | |
|---|---|---|---|---|
| 5,785,203 | A * | 7/1998 | Arshinoff | B65D 25/325 220/270 |
| 6,196,404 | B1 * | 3/2001 | Chen | B65D 43/0212 206/505 |
| 7,891,514 | B1 * | 2/2011 | Walsh | B65D 43/0212 220/780 |
| 7,926,674 | B2 * | 4/2011 | Luburic | B65D 43/0212 220/780 |
| 8,251,241 | B2 * | 8/2012 | Vadersen | B65D 51/225 220/267 |

* cited by examiner

SEALED PACKAGING CONTAINER

BACKGROUND OF THE INVENTION

The present invention relates to a kind of container, and more specifically relates to a novel sealed packaging container.

A conventional food container or packaging container such as a sealed lunchbox disclosed in CN89210848U, CN87216769U, CN89200752U and CN94222756Y has a sealing mechanism formed by locking components and sealing components such as fasteners, buckles and rotary connections. However, these configurations are deficient in that they are structurally complicated and involve a high cost, and also they are not suitable for food containers made of plastic or paper. CN2058804U (application number 89218416.7) discloses a thermoformed plastic food container using a self-locking mechanism comprising two stepped portions in lieu of fitting structures between two plane surfaces as conventionally used, so that after the food container is closed, it can hardly be opened by itself unless an external force is applied, and also its sealing effect is enhanced. However, there will be a gap existing at the fastening portion between the cover and the body of the food container disclosed in said CN2058804U when it is being squeezed and deformed, thereby still failing to prevent gravy from spilling out.

CN1820379A (application number 200510042475.8) discloses a fully sealed ultra-thin food container, advantageous in having good sealing effect and strengthened pressure resistance, and which can effectively prevent gravy from spilling out and whose cover will not be easily displaced even when the elastic food container body is being squeezed. The invention comprises a cover and a body; a periphery of the cover is extended upwardly to form a groove inner wall; an upper end of the groove inner wall is extended horizontally and outwardly to form a groove top; an outer end of the groove top is then extended downwardly to form a groove outer wall; the groove inner wall, the groove top and the groove outer wall form an annular groove with a groove opening facing downwardly; a periphery of the body is extended upwardly to form an inner edge, an upper end of the inner edge is extended horizontally and outwardly to form a horizontal edge, and an outer end of the horizontal edge is extended downwardly to form an outer edge; the inner edge, the horizontal edge and the outer edge form a complex edge at the periphery of the body; the complex edge is snap-fitted into the annular groove, such that an inner side surface of the groove inner wall is fitted with an outer side surface of the inner edge of the complex edge; a locking portion is provided at where the inner side surface of the groove inner wall is fitted with the outer side surface of the inner edge of the complex edge; an inner side surface of the groove outer wall of the annular groove is configured with a protrusion protruding horizontally and inwardly; said protrusion abuts against a lower end of the outer edge of the complex edge; the outer edge of the complex edge is tilted downwardly and outwardly, and the lower end thereof also abuts against the inner side surface of the groove outer wall of the annular groove.

In said CN1820379A, the inner side surface of the groove inner wall of the annular groove is fitted with the outer side surface of the inner edge of the complex edge, and the locking portion is provided at where the inner side surface of the groove inner wall of the annular groove is fitted with the outer side surface of the inner edge of the complex edge, so as to form an inner sealed structure. The outer edge of the complex edge is tilted downwardly and outwardly, and the lower end of the outer edge abuts against the inner side surface of the groove outer wall of the annular groove, so as to form an outer sealed structure. The inner side surface of the groove outer wall is provided with the protrusion protruding horizontally and inwardly, and that protrusion also abuts against the lower end of the outer edge of the complex edge, so as to form a fastening structure that prevents disengagement. Therefore, said CN1820379A has good sealing effect and strengthened pressure resistance, prevents gravy from spilling out effectively, and prevents the cover from easy displacement in case the elastic body is being squeezed.

However, said CN1820379A has the following disadvantages:

In said CN1820379A, the outer edge of the complex edge is tilted downwardly and outwardly, and the lower end thereof abuts against the inner side surface of the groove outer wall of the annular groove. Since after the cover and the body are closed with respect to each other, the groove outer wall of the annular groove of the cover will be at an outermost position while the outer edge of the complex edge of the body is positioned inwardly with respect to the groove outer wall, when the food container is subject to squeezing from outside at a position corresponding to a bottom part of the complex edge, the complex edge will be deformed inwardly and experiences an inward and downward pulling force which overcomes the fastening effect of the fastening structure. As a result, the lower end of the outer edge of the complex edge no longer abuts against the protrusion configured at the inner side surface of the groove outer wall of the annular groove. Accordingly, reliability of the fastening structure that prevents disengagement has to be strengthened for this kind of packaging container when subject to external force. Moreover, due to unreliability of the fastening structure, the sealing effect of this kind of packaging container is also weakened.

BRIEF SUMMARY OF THE INVENTION

An object of the present invention is to provide a novel sealed packaging container which provides a reliable fastening structure that prevents disengagement, and which achieves better sealing effect.

To fulfill the above object, the present invention provides the following technical solutions:

A novel sealed packaging container, comprising a cover and a hollow body having an opening; a periphery of the cover is extended outwardly, and the extended periphery of the cover is formed as a first inner fitting groove having an annular shape and a groove opening facing downwardly towards a bottom part of the body; an outer groove wall of the first inner fitting groove has a bottom end that extends further outwardly, and then bends and extends upwardly away from the bottom part of the body, thus forming a first outer fitting groove having an annular shape and a groove opening facing upwardly away from a bottom part of the body; a periphery at the opening of the body is extended outwardly, and the extended periphery of the body is formed as a second inner fitting groove having an annular shape and a groove opening facing downwardly towards a bottom part of the body; an outer groove wall of the second inner fitting groove has a bottom end that extends further outwardly, and then bends and extends upwardly away from the bottom part of the body, thus forming a second outer fitting groove having an annular shape and a groove opening facing upwardly away from a bottom part of the body; the first inner fitting groove, the first outer fitting groove, the second inner fitting groove and the second outer fitting groove are elastic; the second inner fitting groove is snap-fitted into the first inner fitting groove, and the first outer fitting groove is snap-fitted into the second outer fitting groove.

An inner side surface of an outer groove wall of the second outer fitting groove is configured with position limiting blocks; the position limiting blocks abut against a top end of an outer groove wall of the first outer fitting groove; and/or the outer groove wall of the second outer fitting groove is configured to have a reverse tapered shape; the outer groove wall of the first outer fitting groove and the outer groove wall of the second outer fitting groove are in surface contact with each other or are in linear contact with each other by having the outer groove wall of the first outer fitting groove elastically abutting against the outer groove wall of the second outer fitting groove; and/or a first inner press component and a second inner press component engaged with each other are provided on an outer side surface of an inner groove wall of the first inner fitting groove and an inner side surface of an inner groove wall of the second inner fitting groove respectively, and/or a first outer press component and a second outer press component engaged with each other are provided on an inner side surface of the outer groove wall of the first inner fitting groove and an outer side surface of the outer groove wall of the second inner fitting groove respectively.

The inner groove wall of the first inner fitting groove and the inner groove wall of the second inner fitting groove are adjacently in contact with each other through corresponding tapering surfaces; or the outer groove wall of the first inner fitting groove and the outer groove wall of the second inner fitting groove are adjacently in contact with each other through corresponding tapering surfaces; and/or an outer groove wall of the first outer fitting grove and the outer groove wall of the second outer fitting groove are adjacently in contact with each other through corresponding tapering surfaces or in linear contact with each other by elastic abutment.

The inner groove wall of the first inner fitting groove and the inner groove wall of the second inner fitting groove are in linear contact with each other by elastic abutment, and/or the outer groove wall of the first inner fitting groove and the outer groove wall of the second inner fitting groove are in linear contact with each other by elastic abutment.

Two seams that enable easy tearing are extended downwardly from a top end of the outer groove wall of the second outer fitting groove; a portion of the outer groove wall enclosed by the two seams defines a counterfeit tearable strip; depths of the two seams are slightly smaller than a thickness of the outer groove wall of the second outer fitting groove.

The extended periphery of the cover forming as the first inner fitting groove is first bent upwardly away from the bottom part of the body to form an inner groove wall of the first inner fitting groove, and then an upper end portion of the inner groove wall of the first inner fitting groove is bent outwardly to form a groove top of the first inner fitting groove, and finally an outer end portion of the groove top is bent downwardly to form the outer groove wall of the first inner fitting groove or an inner groove wall of the first outer fitting groove; further, a bottom end of the outer groove wall of the first inner fitting groove is further extended outwardly to form a groove bottom of the first outer fitting groove, and an outer end of the groove bottom of the first outer fitting groove is further bent and extended upwardly away from the bottom part of the body to form the outer groove wall of the first outer fitting groove; the extended periphery of the body forming as the second inner fitting groove is first bent upwardly away from the bottom part of the body to form an inner groove wall of the second inner fitting groove, and then an upper end portion of the inner groove wall of the second inner fitting groove is bent outwardly to form a groove top of the second inner fitting groove, and finally an outer end portion of the groove top of the second inner fitting groove is bent downwardly to form the outer groove wall of the second inner fitting groove or an inner groove wall of the second outer fitting groove; further, a bottom end of the outer groove wall of the second inner fitting groove is further extended outwardly to form a groove bottom of the second outer fitting groove, and an outer end of the groove bottom of the second outer fitting groove is further bent and extended upwardly away from the bottom part of the body to form the outer groove wall of the second outer fitting groove.

The inner groove wall of the first inner fitting groove, the inner groove wall of the second inner fitting groove, the outer groove wall of the first inner fitting groove, and the outer groove wall of the second inner fitting groove are tapered by 2 to 12 degrees.

The first outer fitting groove and/or the second inner fitting groove is/are filled with solid tapered piece(s).

The first outer fitting groove is snap-fitted into the second outer fitting groove by interference fit, and/or the second inner fitting groove is snap-fitted into the first inner fitting groove by interference fit.

A first inner press component is provided on an outer side surface of the inner groove wall of the first inner fitting groove, or a second inner press component is provided on an inner side surface of the inner groove wall of the second inner fitting groove, or a first outer press component is provided on an inner side surface of the outer groove wall of the first inner fitting groove, or a second outer press component is provided on an outer side surface of the outer groove wall of the second inner fitting groove.

The inner groove wall of the second inner fitting groove and the inner groove wall of the first inner fitting groove are tangential with respect to each other, and/or the outer groove wall of the second inner fitting groove and the outer groove wall of the first inner fitting groove are tangential with respect to each other.

The seams are configured to extend down to a bottom end portion of the outer groove wall of the second outer fitting groove, and the groove bottom of the second outer fitting groove is provided with a plurality of hollowed portions corresponding to the counterfeit tearable strip; the hollowed portions define a plurality of connecting ribs connecting the counterfeit tearable strip and an inner groove wall of the second outer fitting groove; each of the hollowed portions is sealed by being covered with a thin film.

Advantageous Effects of the Present Invention

According to the present invention as disclosed above, the second inner fitting groove is snap-fitted into the first inner fitting groove; the first outer fitting groove is snap-fitted into the second outer fitting groove; therefore, a double snap-fitting structure having mutually reversed snap-fitting relationships is formed between the periphery of the cover and the periphery of the opening of the body, thereby increasing the strength of fitting between the cover and the body. The fastening structure of the present invention has five different embodiments: the first one achieved through the position limiting blocks, the second and the third ones achieved through the reverse taper shape of the outer groove wall of the second outer fitting groove, and the fourth and the fifth ones achieved through press components. In the first embodiment of the fastening structure using position limiting blocks, the position limiting blocks are positioned above the top end of the outer groove wall of the first outer fitting groove, and by fastening the position limiting blocks onto the top end of the outer groove wall of the first outer fitting groove, the first fastening structure is formed. In the second and third embodiments of the fastening structure using the reverse taper shape of the outer groove wall of the second outer fitting groove, the outer groove wall of the first outer fitting groove and the outer groove wall of the second outer fitting groove are in surface contact with each other or are in linear contact with each other by having the outer groove wall of the first outer fitting groove elastically abutting against the outer groove wall of the second outer fitting groove; by using the reverse taper shape of the outer groove wall of the second outer fitting groove to fasten onto the outer groove wall of the first outer fitting groove, the second and the third fastening structures are formed. In the fourth and fifth embodiments of the fastening structure using the press components, the first inner press component and the second inner press component engaged with each other are provided on the outer side surface of the inner groove wall of the first inner fitting groove and the inner side surface of the inner groove wall of the second inner fitting groove respectively, and/or the first outer press component and the second outer press component engaged with each other are provided on the inner side surface of the outer groove wall of the first inner fitting groove and the outer side surface of the outer groove wall of the second inner fitting groove respectively, thereby forming the fourth and the fifth fastening structures.

When external pressure or twisting force applies to the body at a position right below the periphery of the opening of the body, the body will be deformed inwardly, and as such, the second inner fitting groove and the second outer fitting groove are both subject to an inward and downward pulling force; since the second inner fitting groove and the second outer fitting groove as well as the first inner fitting groove and the first outer fitting groove are configured with mutually reversed snap-fitting relationships, and also the second outer fitting groove is positioned outwardly with respect to the first outer fitting groove, the inward and downward pulling force caused by external force upon the second inner fitting groove and the second outer fitting groove will result in an even tighter pressing force of the second outer fitting groove on the first outer fitting groove, thereby ensuring the stability and reliability of each of the fastening structures, also, the greater the external pressing or twisting force is, the tighter the pressing force and thus the greater the fastening effect of the fastening structures. Accordingly, the novel sealed packaging container of the present invention can effectively overcome external pressing and twisting force, and provide more reliable fastening structures having greater mechanical strength. Further, according to the present invention, at least one corresponding pair of side walls between the first inner fitting groove and the second inner fitting groove and between the first outer fitting groove and the second outer fitting groove has said corresponding side walls having corresponding tapered/reverse tapered shapes causing said corresponding side walls of each pair to be in contact with each other respectively. Due to corresponding tapered/reverse tapered shape, sealing between the periphery of the cover and the periphery of the opening of the body is achieved. Moreover, according to the present invention, the inner groove wall of the first inner fitting groove and the inner groove wall of the second inner fitting groove are in linear contact with each other by elastic abutment, and/or the outer groove wall of the first inner fitting groove and the outer groove wall of the second inner fitting groove are in linear contact with each other by elastic abutment. Through the linear contact between the inner groove wall of the first inner fitting groove and the inner groove wall of the second inner fitting groove, and/or the linear contact between the outer groove wall of the first inner fitting groove and the outer groove wall of the second inner fitting groove, an inner sealing structure and/or an intermediate sealing structure between the periphery of the cover and the periphery of the opening of the body is/are formed, thereby enhancing the sealing effect between the periphery of the cover and the periphery of the opening of the body. Further, two seams that enable easy tearing are extended downwardly from a top end of the outer groove wall of the second outer fitting groove; a portion of the outer groove wall enclosed by the two seams defines a counterfeit tearable strip; depths of the two seams are slightly smaller than a thickness of the outer groove wall of the second outer fitting groove. The counterfeit tearable strip on one hand achieves the purpose of counterfeit, and on the other hand exposes the outer groove wall of the first outer fitting groove through a gap appearing on the outer groove wall of the second outer fitting groove after the counterfeit tearable strip is tom away downwardly, thereby facilitating the cover to be opened as the user may conveniently lift up the cover through the gap. Besides, the seams do not penetrate through the thickness of the outer groove wall of the second outer fitting groove, thereby ensuring the sealing effect of the packaging box.

The first outer fitting groove and/or the second inner fitting groove is/are filled with solid tapered piece(s). By means of the filled solid tapered piece(s), the structural strengths of the first outer fitting groove and the second inner fitting groove are improved, and the snap-fittings between the second inner fitting groove and the first inner fitting groove and between the first outer fitting groove and the second outer fitting groove can become more stable.

Further, the first outer fitting groove is snap-fitted into the second outer fitting groove by interference fit, and/or the second inner fitting groove is snap-fitted into the first inner fitting groove by interference fit. By means of interference fit, more reliable sealing effect can be obtained at the inner sealing structure and/or the intermediate sealing structure, and also the outer sealing structure.

Further, the first inner press component is provided on an outer side surface of the inner groove wall of the first inner fitting groove, or the second inner press component is provided on an inner side surface of the inner groove wall of the second inner fitting groove, or the first outer press component is provided on an inner side surface of the outer groove wall of the first inner fitting groove, or the second outer press component is provided on an outer side surface of the outer groove wall of the second inner fitting groove. On one hand, the press components serve as linear seals between two corresponding groove walls. On the other hand, due to pressing force and abutment caused by the press components, the sealing effect of the linear seals or surface seals between two corresponding groove walls can be further enhanced.

Further, the inner groove wall of the second inner fitting groove and the inner groove wall of the first inner fitting groove are tangential with respect to each other, and/or the outer groove wall of the second inner fitting groove and the outer groove wall of the first inner fitting groove are tangential with respect to each other. Tangential arrangements of two corresponding groove walls constitute linear seals.

Further, the seams extend down to a bottom end portion of the outer groove wall of the second outer fitting groove, and the groove bottom of the second outer fitting groove is provided with a plurality of hollowed portions corresponding to the counterfeit tearable strip; the hollowed portions define a plurality of connecting ribs connecting the counterfeit tearable strip and the inner groove wall of the second outer fitting groove; each of the hollowed portions is sealed by being covered with a thin film. When the counterfeit tearable strip is configured to be capable of being completely torn away, the groove bottom of the second outer fitting groove is provided with a plurality of hollowed portions corresponding to the counterfeit tearable strip, and each of the hollowed portions is sealed by being covered with a thin film, thereby further ensuring the sealing effect between the periphery of the cover and the periphery of the opening of the body.

DETAILED DESCRIPTION OF THE INVENTION

The present invention will be described in detail below with reference to the drawings.

The present invention provides a novel sealed packaging container. For ease of description, a packaging box is used as an illustrative example.

In the present invention, "inward/inner" refers to an orientation towards a central axis of the packaging box. By contrast, "outward/outer" refers to an orientation away from the central axis of the packaging box.

In the present invention, a cover and a body of the packaging box are both entirely made of elastic material. Alternatively, only portions where the cover and the body are fitted together are made of elastic material. Said elastic material can be an ultra-thin injection molding material having good elastoplasticity. Alternatively, other elastic materials such as thicker plastics or elastic metals can be used.

Embodiment 1

Figure 1:
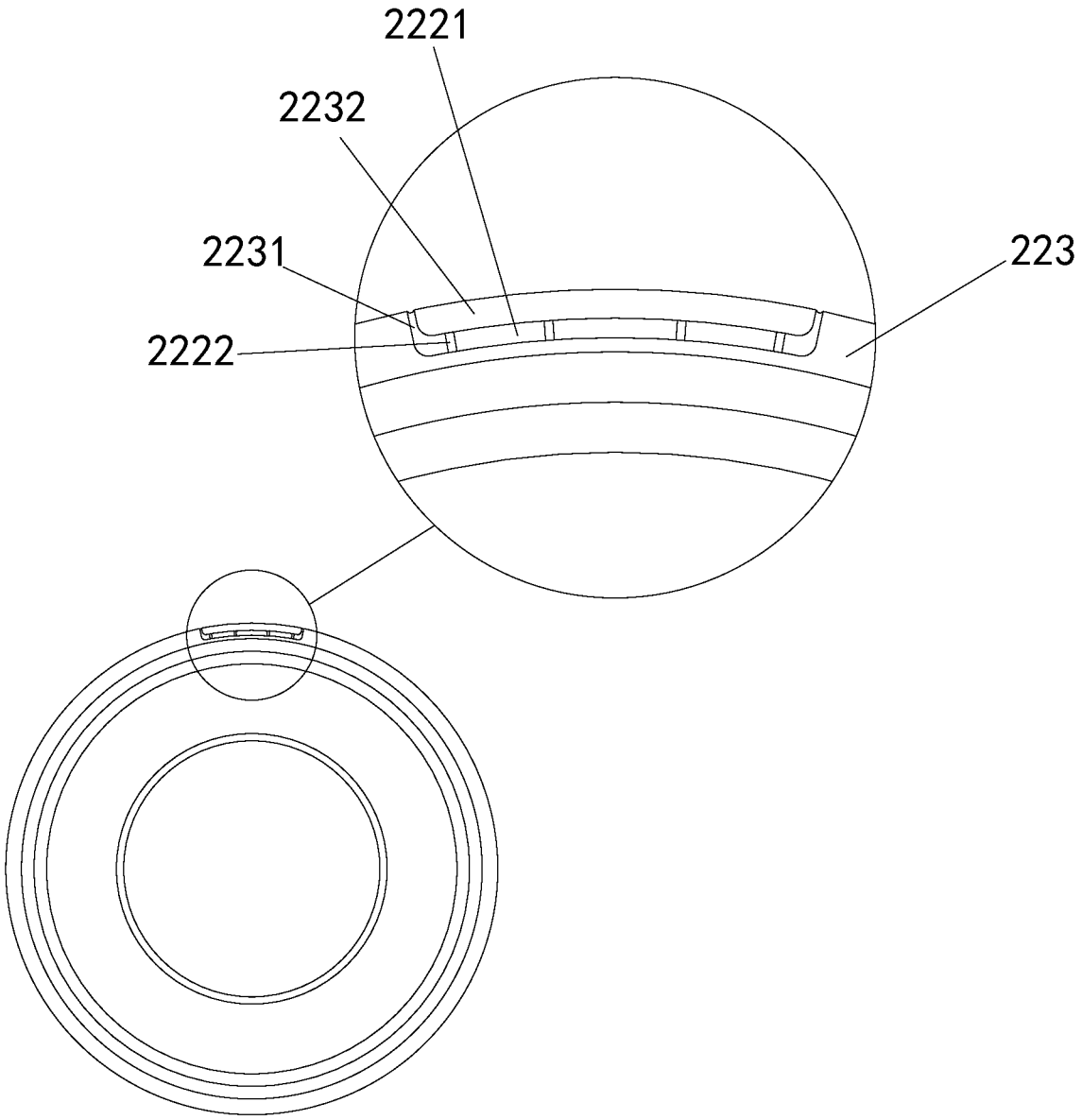
FIG. 1 is a schematic bottom view showing an overall structure of the present invention according to embodiment 1.
Figure 2:
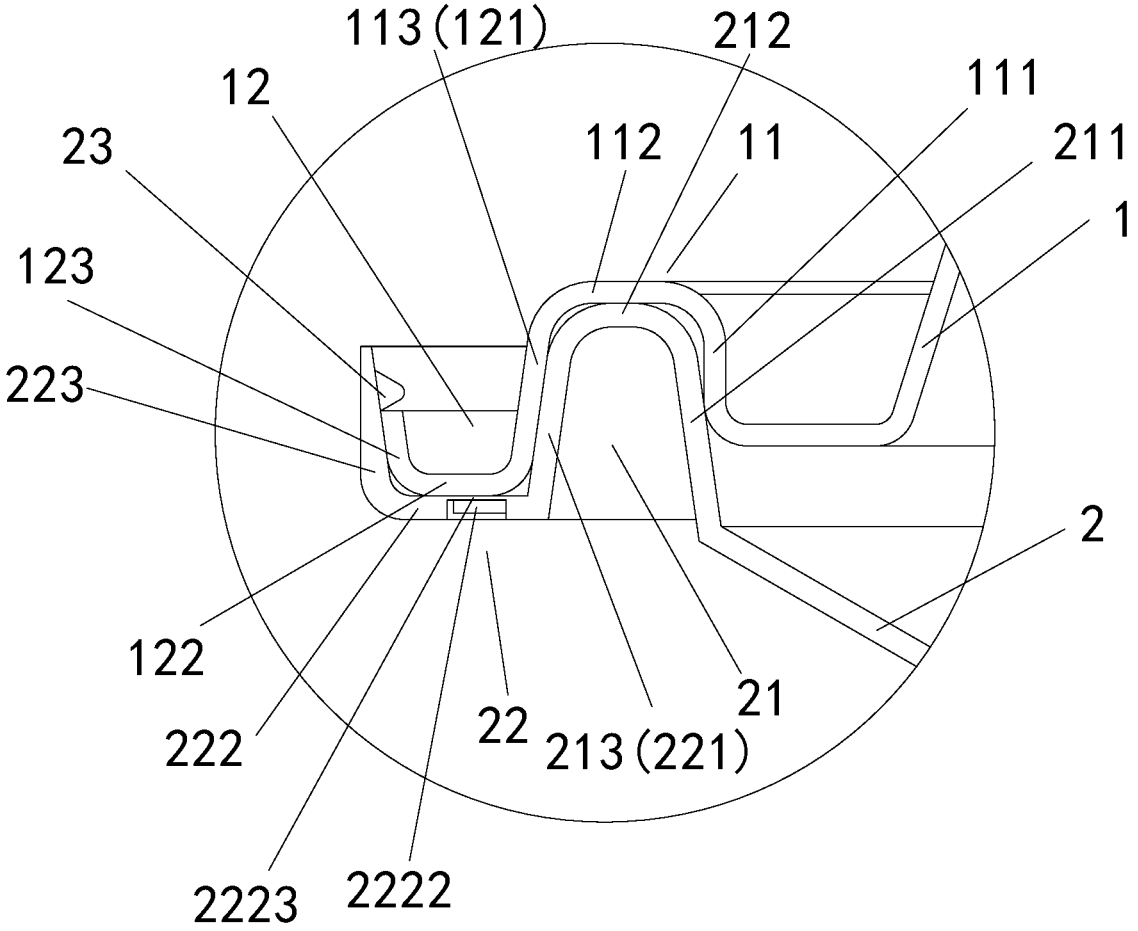
FIG. 2 is a schematic structural view of embodiment 1 of the present invention showing the cover and the body fitted with each other.
Figure 3:
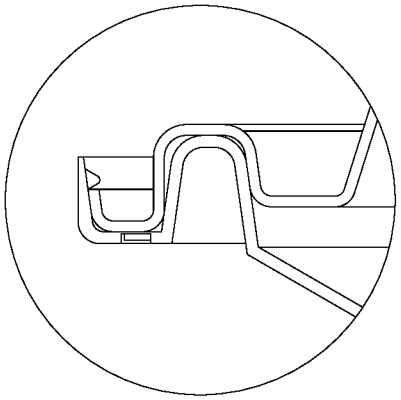
FIG. 3 to FIG. 29 are schematic structural views according to embodiments 2 to 28 respectively each showing the cover and the body fitted with each other.
Figure 4:
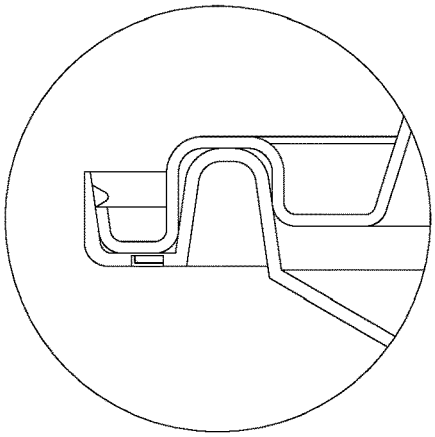
Figure 5:
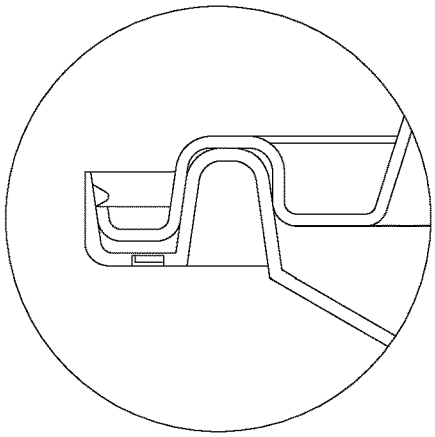
Figure 6:
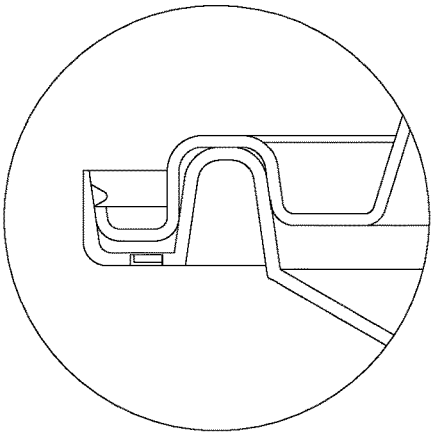
Figure 7:
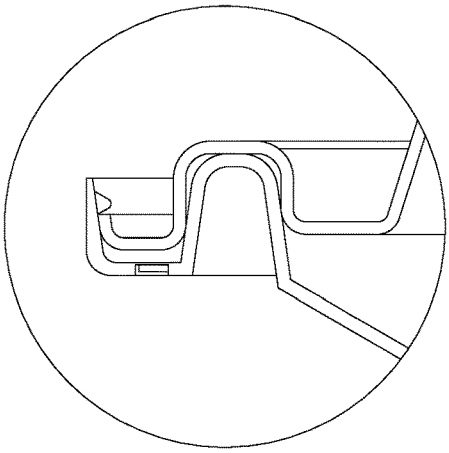
Figure 8:
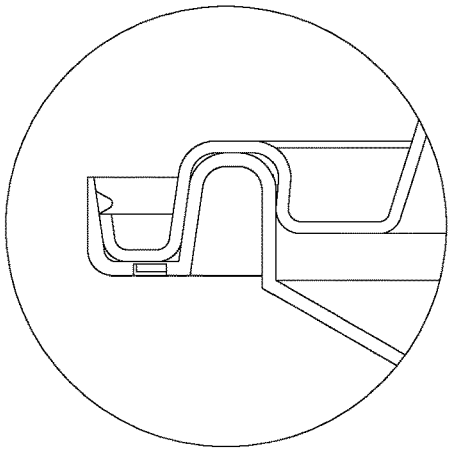
Figure 9:
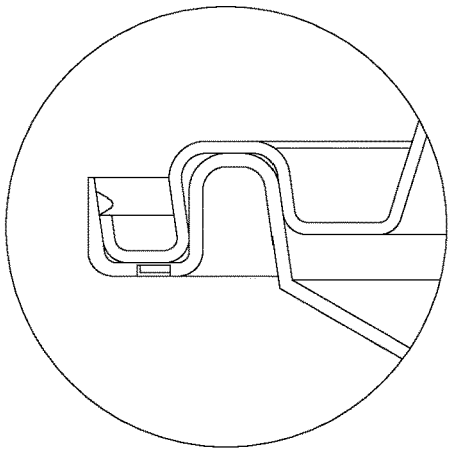
Figure 10:
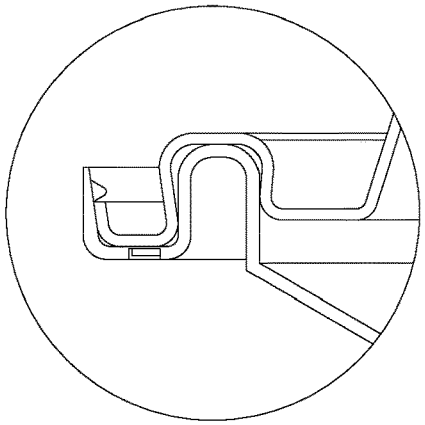
Figure 11:
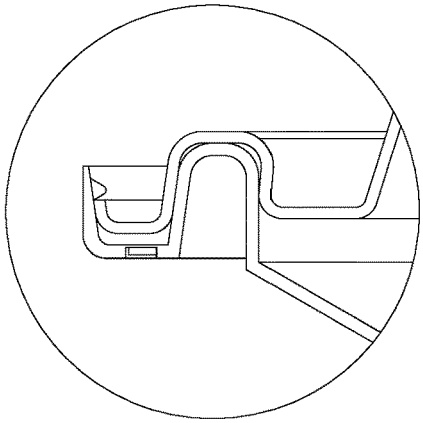
Figure 12:
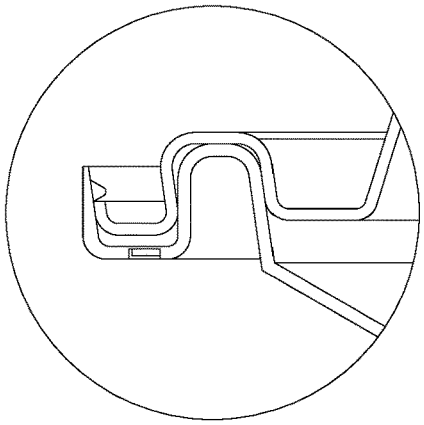
Figure 13:
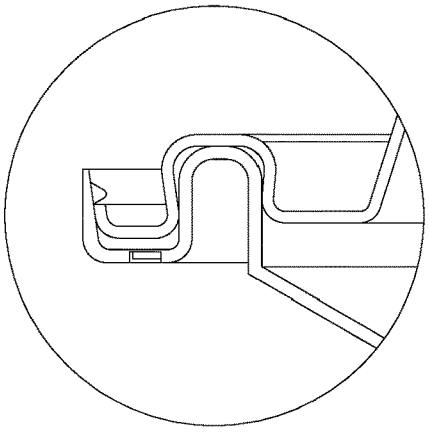
Figure 14:
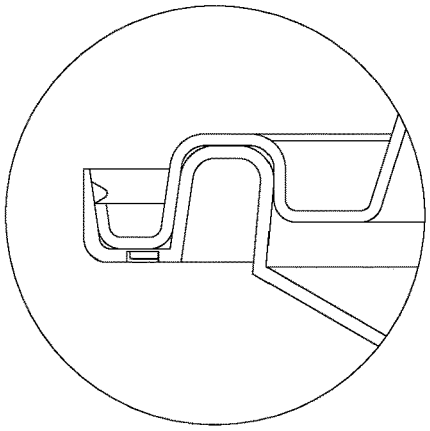
Figure 15:
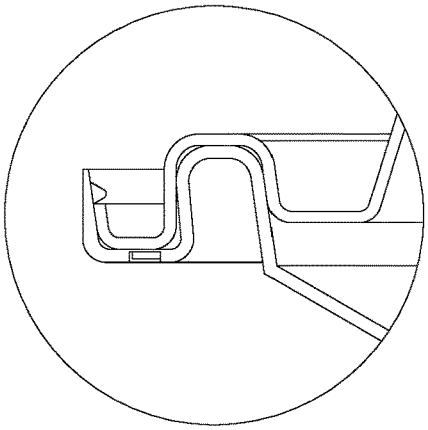
Figure 16:
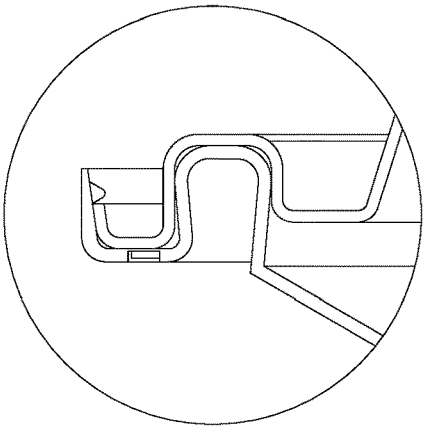
Figure 17:
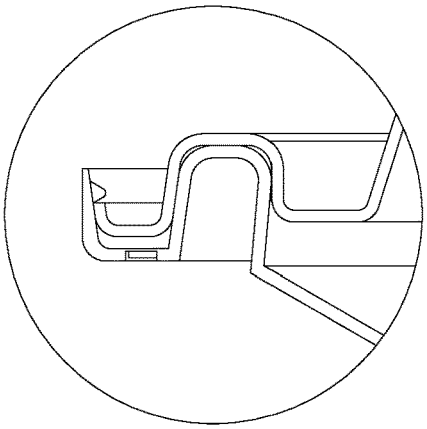
Figure 18:
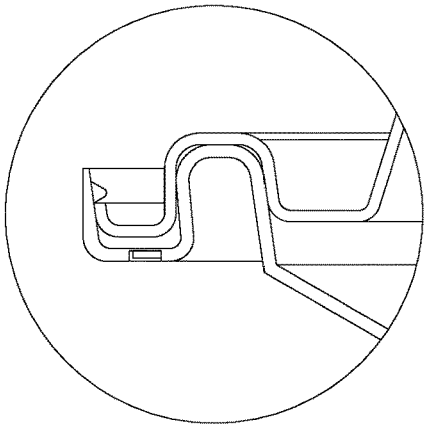
Figure 19:
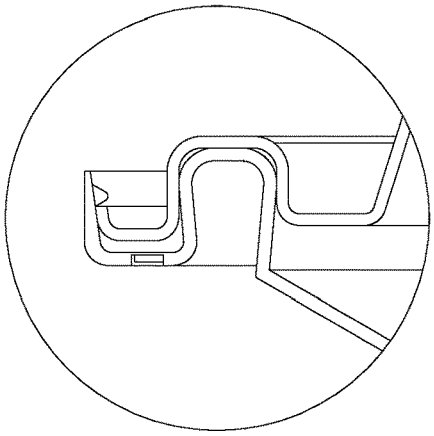
Figure 20:
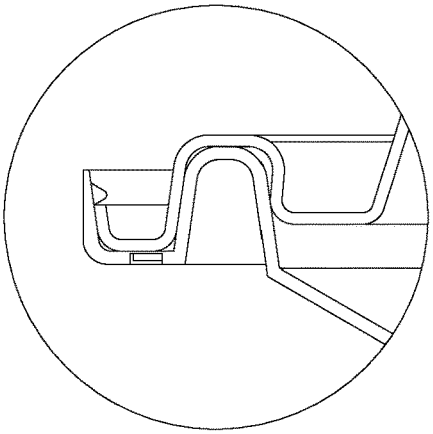
Figure 21:
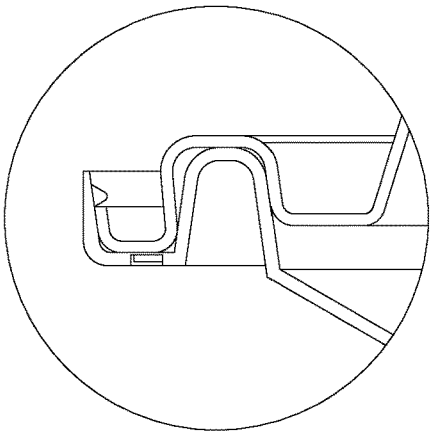
Figure 22:
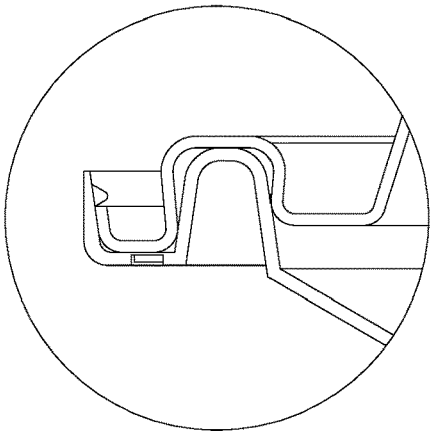
Figure 23:
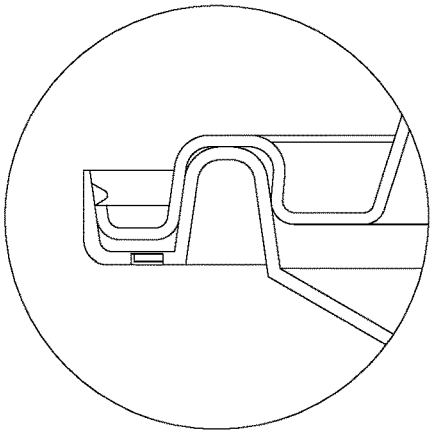
Figure 24:
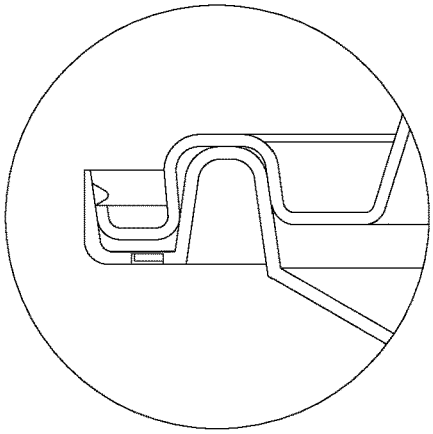
Figure 25:
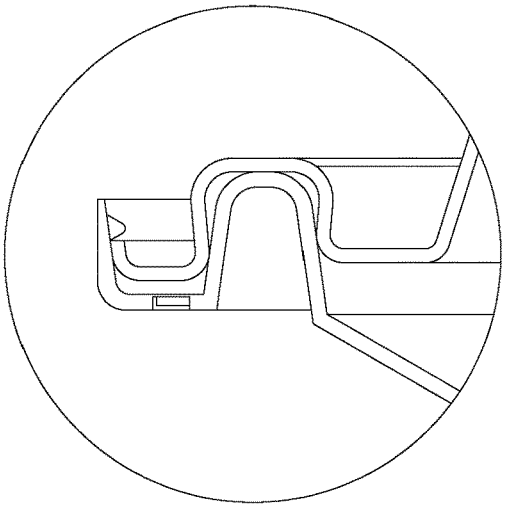

Embodiment 1 of the novel sealed packaging container of the present invention is illustrated in FIGS. 1-2, comprising a cover 1 and a hollow body 2; a periphery of the cover 1 is extended outwardly, and the extended periphery of the cover 1 is formed as a first inner fitting groove 11 having an annular shape and a groove opening facing downwardly towards a bottom part of the body; an outer groove wall 113 of the first inner fitting groove 11 has a bottom end that extends further outwardly, and then bends and extends upwardly away from the bottom part of the body, thus forming a first outer fitting groove 12 having an annular shape and a groove opening facing upwardly away from a bottom part of the body. A periphery at an opening of the body 2 is extended outwardly, and the extended periphery of the body 2 is formed as a second inner fitting groove 21 having an annular shape and a groove opening facing downwardly towards a bottom part of the body; an outer groove wall 213 of the second inner fitting groove 21 has a bottom end that extends further outwardly, and then bends and extends upwardly away from the bottom part of the body, thus forming a second outer fitting groove 22 having an annular shape and a groove opening facing upwardly away from a bottom part of the body. The first inner fitting groove 11, the first outer fitting groove 12, the second inner fitting groove 21 and the second outer fitting groove 22 are elastic. An inner side surface of an outer groove wall 223 of the second outer fitting groove 22 is configured with position limiting blocks 23; the second inner fitting groove 21 is snap-fitted into the first inner fitting groove 11, and the first outer fitting groove 12 is snap-fitted into the second outer fitting groove 22. The position limiting blocks 23 abut against a top end of an outer groove wall 123 of the first outer fitting groove 12.

Specifically, the extended periphery of the cover 1 forming as the first inner fitting groove 11 is first bent upwardly away from the bottom part of the body to form an inner groove wall 111 of the first inner fitting groove 11, and then an upper end portion of the inner groove wall 111 is bent outwardly to form a groove top 112 of the first inner fitting groove 11, and finally an outer end portion of the groove top 112 is bent downwardly to form the outer groove wall 113 of the first inner fitting groove 11 which is also an inner groove wall 121 of the first outer fitting groove 12 (same wall being commonly used as the outer groove wall 113 of the first inner fitting groove 11 and the inner groove wall 121 of the first outer fitting groove 12); further, the bottom end of the outer groove wall 113 of the first inner fitting groove 11 is further extended outwardly to form a groove bottom 122 of the first outer fitting groove 12, and an outer end of the groove bottom 122 of the first outer fitting groove 12 is further bent and extended upwardly away from the bottom part of the body to form the outer groove wall 123 of the first outer fitting groove 12.

Specifically, the extended periphery of the body 2 forming as the second inner fitting groove 21 is first bent upwardly away from the bottom part of the body to form an inner groove wall 211 of the second inner fitting groove 21, and then an upper end portion of the inner groove wall 211 of the second inner fitting groove 21 is bent outwardly to form a groove top 212 of the second inner fitting groove 21, and finally an outer end portion of the groove top 212 of the second inner fitting groove 21 is bent downwardly to form the outer groove wall 213 of the second inner fitting groove 21 which is also an inner groove wall 221 of the second outer fitting groove 22 (same wall being commonly used as the outer groove wall 213 of the second inner fitting groove 21 and the inner groove wall 221 of the second outer fitting groove 22); further, the bottom end of the outer groove wall 213 of the second inner fitting groove 21 is further extended outwardly to form a groove bottom 222 of the second outer fitting groove 22, and an outer end of the groove bottom 222 of the second outer fitting groove 22 is further bent and extended upwardly away from the bottom part of the body to form the outer groove wall 223 of the second outer fitting groove 22.

The second inner fitting groove 21 is snap-fitted into the first inner fitting groove 11; the first outer fitting groove 12 is snap-fitted into the second outer fitting groove 22; therefore, a double snap-fitting structure having mutually reversed snap-fitting relationships is formed between the periphery of the cover 1 and the periphery of the opening of the body 2, thereby increasing the strength of fitting between the cover 1 and the body 2. Also, since the position limiting blocks 23 are positioned above the top end of the outer groove wall 123 of the first outer fitting groove 12, the position limiting blocks 23 abut against the top end of the outer groove wall 123 of the first outer fitting groove 12 to form a fastening structure that prevents disengagement between the cover and the body. When external pressure or twisting force applies to the body 2 at a position right below the periphery of the opening of the body 2, the body 2 will be deformed inwardly, and as such, the second inner fitting groove 21 and the second outer fitting groove 22 are both subject to an inward and downward pulling force; since the second inner fitting groove 21 and the second outer fitting groove 22 as well as the first inner fitting groove 11 and the first outer fitting groove 12 are configured with mutually reversed snap-fitting relationships, and also the second outer fitting groove 22 is positioned outwardly with respect to the first outer fitting groove 12, the inward and downward pulling force caused by external force upon the second inner fitting groove 21 and the second outer fitting groove 22 will result in an even tighter pressing force of the second outer fitting groove 22 on the first outer fitting groove 12, in other words, the position limiting blocks 23 will be more tightly pressed against the top end of the outer groove wall 123 of the first outer fitting groove 12 to attain fastening effect, and the greater the external pressing or twisting force is, the tighter the pressing force and thus the greater the fastening effect of the fastening structure will become. Accordingly, the novel sealed packaging container of the present invention can effectively overcome external pressing and twisting force, and provide a more reliable fastening structure having a greater mechanical strength.

The position limiting blocks 23 are circumferentially distributed in intervals around the inner side surface of the outer groove wall 223 of the second outer fitting groove 22. The position limiting blocks 23 are rounded protrusions or pointed protrusions. Alternatively, the position limiting blocks 23 may form as a single closed ring running circumferentially around the inner side surface of the outer groove wall 223 of the second outer fitting groove 22.

The inner groove wall 111 of the first inner fitting groove 11 is vertical, and the corners of which have an arc shape. The outer groove wall 113 of the first inner fitting groove 11, the outer groove wall 123 of the first outer fitting groove 12, the inner groove wall 211 of the second inner fitting groove 21 and the outer groove wall 223 of the second outer fitting groove 22 are tapered. The second inner fitting groove 21 is snap-fitted into the first inner fitting groove 11 by interference fit; the first outer fitting groove 12 is snap-fitted into the second outer fitting groove 22 by interference fit.

The inner groove wall 121 of the first outer fitting groove 12 and the inner groove wall 221 of the second outer fitting groove 22 are adjacently in contact with each other through corresponding tapering surfaces so as to form an intermediate sealing structure.

By means of interference fit, a lower arc-shaped corner of the inner groove wall 111 of the first inner fitting groove 11 and the inner groove wall 211 of the second inner fitting groove are tangential with respect to each other, thus forming an inner sealing structure.

Two seams 2231 that enable easy tearing are extended downwardly from a top end of the outer groove wall 223 of the second outer fitting groove 22. Depths of the seams 2231 are slightly smaller than a thickness of the outer groove wall 223 of the second outer fitting groove 22. Preferably, the depths of the seams 2231 are smaller than the thickness of the outer groove wall 223 of the second outer fitting groove 22 by 0.05-0.10 mm. The two seams 2231 divide the outer groove wall 223 of the second outer fitting groove 22 into two parts, wherein a first part is a tearable part which is a portion of the outer groove wall 223 enclosed by the two seams 223, while a second part is the remaining portion of the outer groove wall 223. Said tearable part serves as a counterfeit tearable strip 2232. The counterfeit tearable strip 2232 on one hand achieves the purpose of counterfeit, and on the other hand exposes the outer groove wall 123 of the first outer fitting groove 12 through a gap appearing on the outer groove wall 223 of the second outer fitting groove 22 after the counterfeit tearable strip 2232 is tom away, thereby facilitating the cover 1 to be opened as the user may conveniently lift up the cover 1 through the gap.

The seams 2231 may extend from the top end of the outer groove wall 223 of the second outer fitting groove 22 until half a height of the outer groove wall 223 of the second outer fitting groove 22; alternatively, the seams 2231 may extend through the entire height of the outer groove wall 223 of the second outer fitting groove 22. In the present embodiment, the counterfeit tearable strip 2232 is configured to be able to completely torn away, and the seams 2231 are configured to extend through the entire height of the outer groove wall 223 of the second outer fitting groove 22, and the groove bottom 222 of the second outer fitting groove 22 is provided with a plurality of hollowed portions 2221 corresponding to the counterfeit tearable strip 2232; the hollowed portions 2221 define a plurality of connecting ribs 2222 connecting the counterfeit tearable strip 2232 and an inner groove wall 221 of the second outer fitting groove 22; each of the hollowed portions 2221 is sealed by being covered with a thin film 2223. The use of thin film 2223 to cover and thus seal each of the hollowed portions 2221 can further ensure the sealing effect between the periphery of the cover 1 and the periphery of the opening of the body 2.

Surfaces of the groove bottom 122 of the first outer fitting groove 12 and the groove bottom 222 of the second outer fitting groove 22 mutually facing to each other are adjacently in contact with each other.

Embodiments 2-24

FIGS. 3-25 illustrate embodiments 2-24 respectively which are variations based on the structures disclosed in embodiment 1. As same as embodiment 1, in embodiments 2-24, the second inner fitting groove 21 is snap-fitted into the first inner fitting groove 11 by interference fit; the first outer fitting groove 12 is snap-fitted into the second outer fitting groove 22 by interference fit; the inner groove wall 211 of the second inner fitting groove 21 and the inner groove wall 111 of the first inner fitting groove 11 are tangential with respect to each other, or/and the outer groove wall 213 of the second inner fitting groove 21 and the outer groove wall 113 of the first inner fitting groove 11 are tangential with respect to each other, thereby forming the inner sealing structure or/and the intermediate sealing structure. Also, surfaces of the groove top 212 of the second inner fitting groove 21 and the groove top 112 of the first inner fitting groove 11 facing towards each other are adjacently in contact with each other to form a surface sealing structure; also, surfaces of the groove bottom 222 of the second outer fitting groove 22 and the groove bottom 122 of the first outer fitting groove 12 facing towards each other are adjacently in contact with each other to form another surface sealing structure, or are not in contact with each other; also, surfaces of the outer groove wall 123 of the first outer fitting groove 12 and the outer groove wall 223 of the second outer fitting groove 22 facing towards each other are adjacently in contact with each other to form an outer sealing structure.

The inner groove wall 111 of the first inner fitting groove 11, the outer groove wall 113 of the first inner fitting groove 11, the inner groove wall 211 of the second inner fitting groove 21 and the outer groove wall 213 of the second inner fitting groove 21 can be configured as vertical, tapered, or reverse tapered, and corners of which are in an arc shape. The arc-shaped corners are tangential to the respective groove walls by means of interference fit, thus forming the inner sealing structure and the intermediate sealing structure.

Embodiment 25

Figure 26:
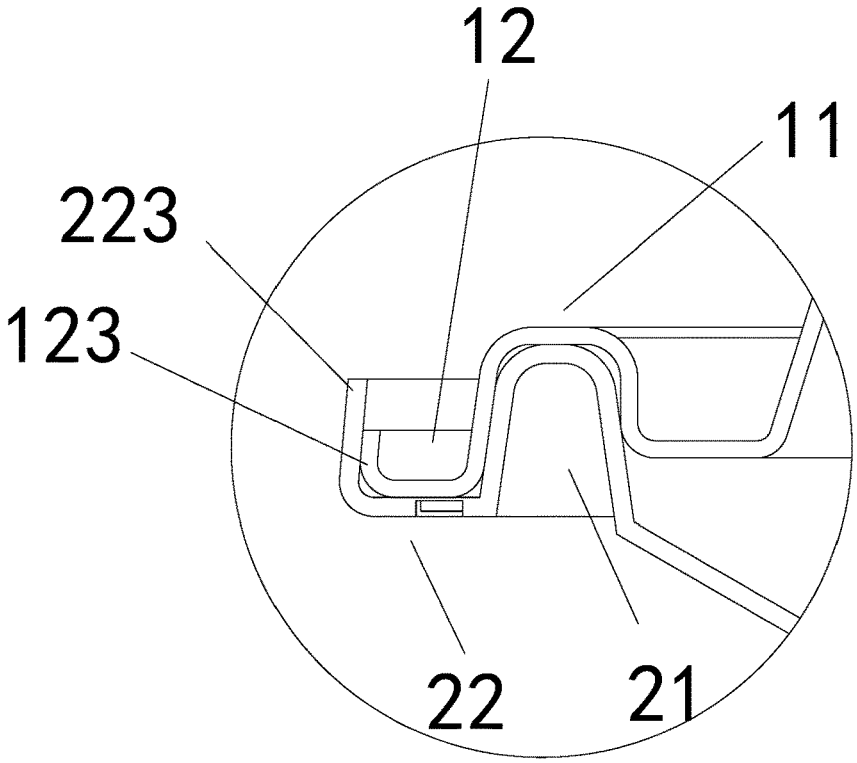

As shown in FIG. 26, the embodiment 25 is different from embodiment 1 only in that: the position limiting blocks 23 are omitted; the outer groove wall 223 of the second outer fitting groove 22 and the outer groove wall 123 of the first outer fitting groove 12 are both in a reverse taper shape and are correspondingly adjacent and in contact with each other. The reverse taper shape of the outer groove wall 223 of the second outer fitting groove 22 enables the outer groove wall 223 of the second outer fitting groove 22 to fasten onto the outer groove wall 123 of the first outer fitting groove 12, thus forming a second fastening structure that prevents disengagement.

Embodiment 26

Figure 27:
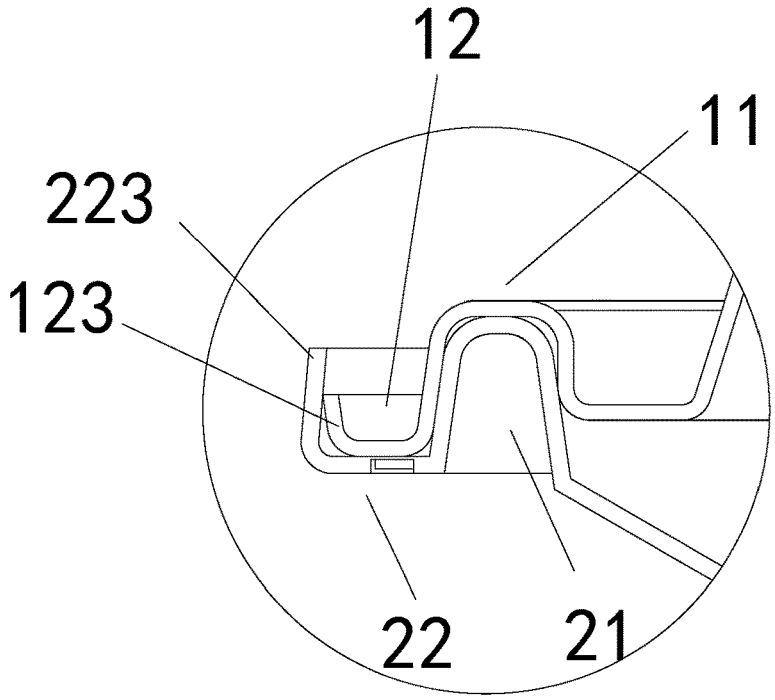

As shown in FIG. 27, embodiment 26 is different from embodiment 1 only in that: the position limiting blocks 23 are omitted; the outer groove wall 223 of the second outer fitting groove 22 has a reverse taper shape; the top end of the outer groove wall 123 of the first outer fitting groove 12 is tilted upwardly and outwardly, and thus being tensioned and abuts against the inner side surface of the outer groove wall 223 of the second outer fitting groove 22, thereby forming the outer sealing structure. By fastening the reverse taper shaped outer groove wall 223 of the second outer fitting groove 22 onto the top end of the outer groove wall 123 of the first outer fitting groove 12, a third fastening structure that prevents disengagement is formed.

Embodiment 27

Figure 28:
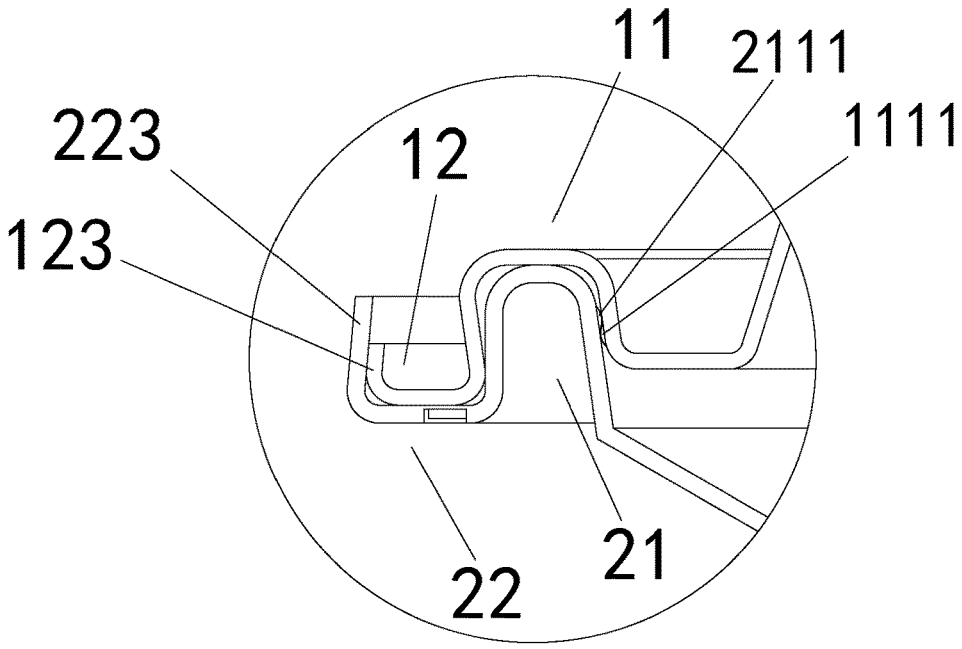

As shown in FIG. 28, embodiment 27 is different from embodiment 25 only in that: the inner groove wall 111 of the first inner fitting groove 11 has a taper shape, the outer groove wall 113 of the first inner fitting groove 11 has a reverse taper shape, and the outer groove wall 213 of the second inner fitting groove 21 is vertical. An inner side surface of the inner groove wall 211 of the second inner fitting groove 21 facing towards the inner groove wall 111 of the first inner fitting groove 11 is additionally provided with a second inner press component 2111 that engages with a first inner press component 1111 on the inner groove wall 111 of the first inner fitting groove 11. Due to mutual engagement between the first inner press component 1111 and the second inner press component 2111, a fourth fastening structure that prevents disengagement is formed.

Embodiment 28

Figure 29:
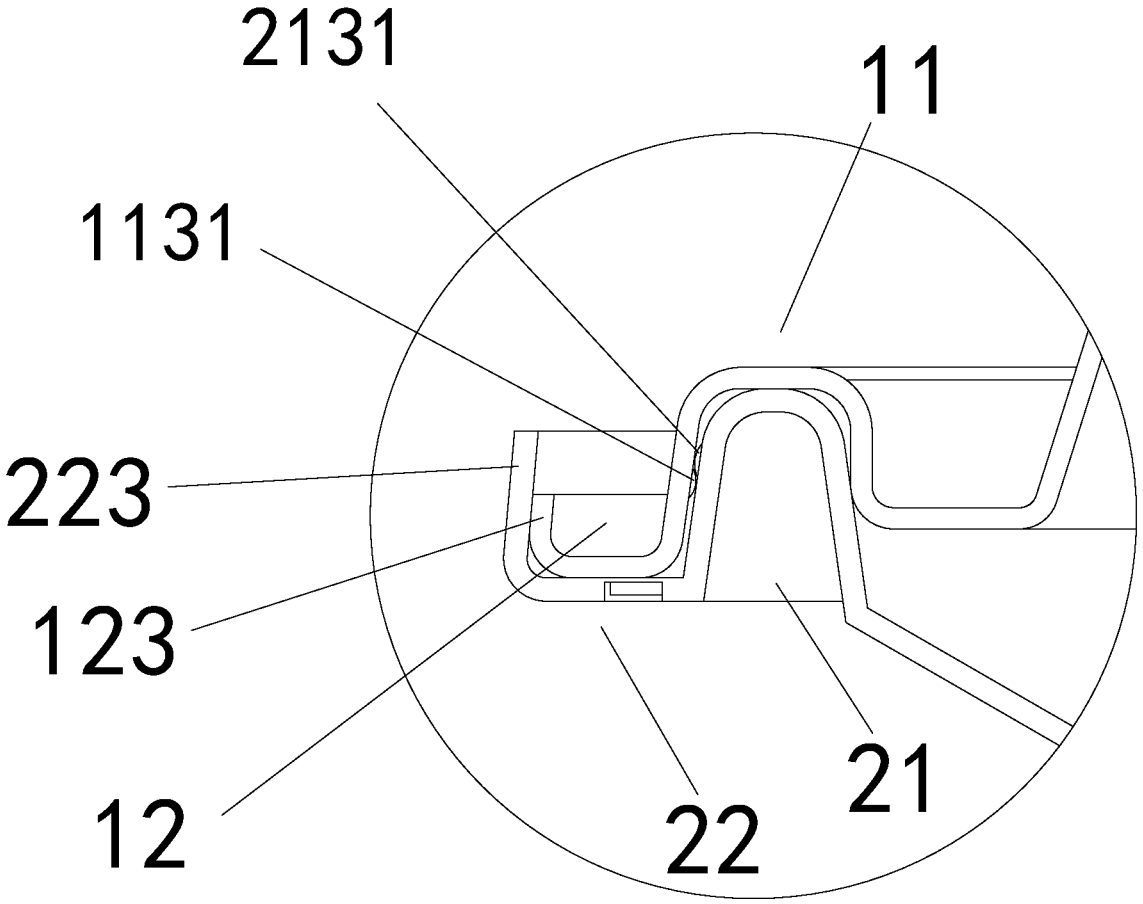

As shown in FIG. 29, embodiment 28 is different from embodiment 25 only in that: the outer groove wall 113 of the first inner fitting groove 11 and the outer groove wall 213 of the second inner fitting groove 21 are not adjacently in contact with each other. An inner side surface of the outer groove wall 113 of the first inner fitting groove 11 is configured with a first outer press component 1131; an outer side surface of the outer groove wall 213 of the second inner fitting groove 21 is configured with a second outer press component 2131; the first outer press component 1131 and the second outer press component 2131 are mutually engaged with each other. Engagement between the first outer press component 1131 and the second outer press component 2131 form a fifth fastening structure that prevents disengagement.

The major inventive concept of the present invention is that: By configuring the first inner fitting groove and the first outer fitting groove at the periphery of the cover, and configuring the second inner fitting groove and the second outer fitting groove at the periphery of the opening of the body, a double snap-fitting structure having mutually reversed snap-fitting relationships is formed between the periphery of the cover and the periphery of the opening of the body, thereby increasing the strength of fitting between the cover and the body. The fastening structure of the present invention has five different embodiments: the first one achieved through the position limiting blocks, the second and the third ones achieved through the reverse taper shape of the outer groove wall of the second outer fitting groove, and the fourth and the fifth ones achieved through press components. In the first embodiment of the fastening structure using position limiting blocks, the position limiting blocks 23 are positioned above the top end of the outer groove wall 123 of the first outer fitting groove 12, and by fastening the position limiting blocks 23 onto the top end of the outer groove wall 123 of the first outer fitting groove 12, the first fastening structure is formed. In the second and third embodiments of the fastening structure using the reverse taper shape of the outer groove wall 223 of the second outer fitting groove 12, the outer groove wall 123 of the first outer fitting groove 12 and the outer groove wall 223 of the second outer fitting groove 22 are in surface contact with each other or are in linear contact with each other by having the outer groove wall 123 of the first outer fitting groove 12 elastically abutting against the outer groove wall 223 of the second outer fitting groove 22; by using the reverse taper shape of the outer groove wall 223 of the second outer fitting groove 22 to fasten onto the outer groove wall 123 of the first outer fitting groove 12, the second and the third fastening structures are formed. In the fourth and fifth embodiments of the fastening structure using the press components, the first inner press component 1111 and the second inner press component 2111 engaged with each other are provided on the outer side surface of the inner groove wall 111 of the first inner fitting groove 11 and the inner side surface of the inner groove wall 211 of the second inner fitting groove 21 respectively, or/and the first outer press component 1131 and the second outer press component 2131 engaged with each other are provided on the inner side surface of the outer groove wall 113 of the first inner fitting groove 11 and the outer side surface of the outer groove wall 213 of the second inner fitting groove 21 respectively, thereby forming the fourth and the fifth fastening structures.

When external pressure or twisting force applies to the body at a position right below the periphery of the opening of the body, the body will be deformed inwardly, and as such, the second inner fitting groove and the second outer fitting groove are both subject to an inward and downward pulling force; since the second inner fitting groove and the second outer fitting groove as well as the first inner fitting groove and the first outer fitting groove are configured with mutually reversed snap-fitting relationships, and also the second outer fitting groove is positioned outwardly with respect to the first outer fitting groove, the inward and downward pulling force caused by external force upon the second inner fitting groove and the second outer fitting groove will result in an even tighter pressing force of the second outer fitting groove on the first outer fitting groove, thereby ensuring the stability and reliability of each of the fastening structures, also, the greater the external pressing or twisting force is, the tighter the pressing force and thus the greater the fastening effect of the fastening structures. Accordingly, the novel sealed packaging container of the present invention can effectively overcome external pressing and twisting force, and provide more reliable fastening structures having greater mechanical strength. Further, according to the present invention, at least one corresponding pair of side walls between the first inner fitting groove and the second inner fitting groove and between the first outer fitting groove and the second outer fitting groove has said corresponding side walls having corresponding tapered/reverse tapered shapes causing said corresponding side walls of each pair to be in contact with each other respectively. Due to corresponding tapered/reverse tapered shape, sealing between the periphery of the cover and the periphery of the opening of the body is achieved. Moreover, according to the present invention, the inner groove wall of the first inner fitting groove and the inner groove wall of the second inner fitting groove are in linear contact with each other by elastic abutment, and/or the outer groove wall of the first inner fitting groove and the outer groove wall of the second inner fitting groove are in linear contact with each other by elastic abutment. Through the linear contact between the inner groove wall of the first inner fitting groove and the inner groove wall of the second inner fitting groove, and/or the linear contact between the outer groove wall of the first inner fitting groove and the outer groove wall of the second inner fitting groove, an inner sealing structure and/or an intermediate sealing structure between the periphery of the cover and the periphery of the opening of the body is/are formed, thereby enhancing the sealing effect between the periphery of the cover and the periphery of the opening of the body. Further, two seams that enable easy tearing are extended downwardly from a top end of the outer groove wall of the second outer fitting groove; a portion of the outer groove wall enclosed by the two seams defines a counterfeit tearable strip; depths of the two seams are slightly smaller than a thickness of the outer groove wall of the second outer fitting groove. The counterfeit tearable strip on one hand achieves the purpose of counterfeit, and on the other hand exposes the outer groove wall of the first outer fitting groove through a gap appearing on the outer groove wall of the second outer fitting groove after the counterfeit tearable strip is torn away downwardly, thereby facilitating the cover to be opened as the user may conveniently lift up the cover through the gap. Besides, the seams do not penetrate through the thickness of the outer groove wall of the second outer fitting groove, thereby ensuring the sealing effect of the packaging box.

Further, the first inner press component 1111 is provided on an outer side surface of the inner groove wall 111 of the first inner fitting groove 11, or the second inner press component 2111 is provided on an inner side surface of the inner groove wall 211 of the second inner fitting groove 21; alternatively, the first outer press component 1131 is provided on an inner side surface of the outer groove wall 113 of the first inner fitting groove 11, or the second outer press component 2131 is provided on an outer side surface of the outer groove wall 213 of the second inner fitting groove 21. Each of the aforesaid press components can be in the form of a continuous closed ring or in a discontinued form of pointed or teethed configurations arranged in intervals with respect to one another. Due to pressing force and abutment caused by the press components, the sealing effect between the corresponding surfaces of two corresponding groove walls can be further enhanced, also the sealing effect of the inner sealing structure and/or the intermediate sealing structure can also be enhanced. When the press components are in the form of continuous closed rings, the press components serve as linear seals between two corresponding groove walls.

In the embodiments where the position limiting blocks 23 are provided, the top end of the outer groove wall 123 of the first outer fitting groove 12 is fastened below the position limiting blocks 23.

In the embodiments where groove walls of the fitting grooves have taper shapes, the groove walls are tapered by 2 to 12 degrees.

Further, the outer groove wall of the second outer fitting groove is provided with a pulling ring or a handle. By using the pulling ring or the handle, the outer groove wall of the second outer fitting groove can be conveniently pulled outwardly so as to deform the outer groove wall of the second outer fitting groove to expose the outer groove wall of the first outer fitting groove, thereby facilitating the user to open the cover.

Further, a first indentation and a second indentation both vertically configured can be provided on the outer groove wall 223 of the second outer fitting groove 22. Depths of the first indentation and the second indentation are slightly smaller than the thickness of the outer groove wall 223 of the second outer fitting groove 22. By means of the first indentation and the second indentation, a portion of the outer groove wall 223 of the second outer fitting groove 22 between the first indentation and the second indentation can be partially or entirely torn away along the vertical direction which the first indentation and the second indentation are configured, and as a result, the outer groove wall 123 of the first outer fitting groove 12 will be exposed to facilitate users to open the cover.

Further, a notch can be provided at an upper periphery of the outer groove wall 223 of the second outer fitting groove 22; a thin wall zone vertically configured is provided on the outer groove wall 223 of the second outer fitting groove 22 corresponding to the notch. By means of the notch, the thin wall zone can be partially or entirely torn away along the vertical direction which the thin wall zone is configured, and as a result, the outer groove wall 123 of the first outer fitting groove 12 will be exposed to facilitate users to open the cover.

In all the above embodiments, a gap can be provided between the groove bottom 122 of the first outer fitting groove 12 and the groove bottom 222 of the second outer fitting groove 22. The gap may receive a prying tool when opening the packaging box so as to facilitate users to open the packaging box in case the packaging box is made of a material that only allows minimal deformation.

In all the above embodiments, the first outer fitting groove 12 and/or the second inner fitting groove 21 is/are filled with solid tapered piece(s). By means of the filled solid tapered piece(s), the structural strengths of the first outer fitting groove 12 and the second inner fitting groove 21 are improved, and the snap-fittings between the second inner fitting groove 21 and the first inner fitting groove 11 and between the first outer fitting groove 12 and the second outer fitting groove 22 can become more stable.

In the embodiments, only one of the five different embodiments of the fastening structure is used in each embodiment. Alternatively, combined use of two or three or four or all the five embodiments is possible in each embodiment.

The embodiments described above are only intended to clearly illustrate some examples of the present invention, and should not limit the possible embodiments of the present invention. A person skilled in this field of art may change or vary the structures and forms of the present invention on the basis of the above disclosure. It is neither necessary nor possible here to provide exhaustive description of all possible embodiments of the present invention. Any changes or variations which are obvious in light of the essence of the present invention should fall within the scope of protection of the present invention.

What is claimed is:

1. A sealed packaging container, comprising a cover (1) and a hollow body (2) having an opening; characterized in that: a periphery of the cover (1) is extended outwardly, and the extended periphery of the cover (1) is formed as a first inner fitting groove (11) having an annular shape and a groove opening facing downwardly towards a bottom part of the body (2); an outer groove wall (113) of the first inner fitting groove (11) has a bottom end that extends further outwardly, and then bends and extends upwardly away from the bottom part of the body (2), thus forming a first outer fitting groove (12) having an annular shape and a groove opening facing upwardly away from the bottom part of the body (2); a periphery at the opening of the body (2) is extended outwardly, and the extended periphery of the body (1) is formed as a second inner fitting groove (21) having an annular shape and a groove opening facing downwardly towards a bottom part of the body (2); an outer groove wall (213) of the second inner fitting groove (21) has a bottom end that extends further outwardly, and then bends and extends upwardly away from the bottom part of the body (2), thus forming a second outer fitting groove (22) having an annular shape and a groove opening facing upwardly away from the bottom part of the body (2); the first inner fitting groove (11), the first outer fitting groove (12), the second inner fitting groove (21) and the second outer fitting groove (22) are elastic; the second inner fitting groove (21) is snap-fitted into the first inner fitting groove (11), and the first outer fitting groove (12) is snap-fitted into the second outer fitting groove (22);

the sealed packaging container also comprises any one of the following five combinations of features:

an inner side surface of an outer groove wall (223) of the second outer fitting groove (22) is configured with position limiting blocks (23); the position limiting blocks (23) abut against a top end of an outer groove wall (123) of the first outer fitting groove (12); an inner groove wall (111) of the first inner fitting groove (11) and an inner groove wall (211) of the second inner fitting groove (21) are ad adjacently in contact with each other through corresponding tapering surfaces of the inner groove wall (111) of the first inner fitting groove (11) and the inner groove wall (211) of the second inner fitting groove (21), or are in linear contact with each other by elastic abutment where the inner groove wall (211) of the second inner fitting groove (21) and the inner groove wall (111) of the first inner fitting groove (11) are tangential with respect to each other; the outer groove wall (113) of the first inner fitting groove (11) and the outer groove wall (213) of the second inner fitting groove (21) are adjacently in contact with each other through corresponding tapering surfaces of the outer groove wall (113) of the first inner fitting groove (11) and the outer roove wall (213) of the second inner fitting groove (21) or are in linear contact with each other by elastic abutment where the outer groove wall (213) of the second inner fitting groove (21) and the outer groove wall (113) of the first inner fitting groove (11) are tangential with respect to each other; and the outer groove wall (123) of the first outer fitting grove (12) and the outer groove wall (223) of the second outer fitting groove (22) are adjacently in contact with each other through corresponding tapering surfaces of the outer groove wall (123) of the first outer fitting grove (12) and the outer groove wall (223) of the second outer fitting groove (22);

alternatively, the outer groove wall (223) of the second outer fitting groove (22) is configured to have a reverse tapered shape; the outer groove wall (123) of the first outer fitting groove (12) and the outer groove wall (223) of the second outer fitting groove (22) are in surface contact with each other; the outer groove wall (113) of the first inner fitting groove (11) and the outer groove wall (213) of the second inner fitting groove (21) are adjacently in contact with each other through the corresponding tapering surfaces of the outer groove wall (113) of the first inner fitting groove (11) and the outer groove wall (213) of the second inner fitting groove (21), and the inner groove wall (111) of the first inner fitting groove (11) and the inner groove wall (211) of the second inner fitting groove (21) are in linear contact with each other by elastic abutment where the inner groove wall (211) of the second inner fitting groove (21) and the inner groove wall (111) of the first inner fitting groove (11) are tangential with respect to each other;

alternatively, the outer groove wall (123) of the first outer fitting groove (12) and the outer groove wall (223) of the second outer fitting groove (22) are in linear contact with each other by having the outer groove wall (123) of the first outer fitting groove (12) elastically abutting against the outer groove wall (223) of the second outer fitting groove (22); the outer groove wall (113) of the first inner fitting groove (11) and the outer groove wall (213) of the second inner fitting groove (21) are adjacently in contact with each other through the corresponding tapering surfaces of the outer groove wall (113) of the first inner fitting groove (11) and the outer groove wall (213) of the second inner fitting groove (21); and the inner groove wall (111) of the first inner fitting groove (11) and the inner groove wall (211) of the second inner fitting groove (21) are in linear contact with each other by elastic abutment where the inner groove wall (211) of the second inner fitting groove (21) and the inner groove wall (111) of the first inner fitting groove (11) are tangential with respect to each other;

alternatively, the outer groove wall (223) of the second outer fitting groove (22) is configured to have a reverse tapered shape; the outer groove wall (123) of the first outer fitting groove (12) and the outer groove wall (223) of the second outer fitting groove (22) are in surface contact with each other: a first inner press component (1111) and a second inner press component (2111) engaged with each other are provided on an outer side surface of the inner groove wall (111) of the first inner fitting groove (11) and an inner side surface of the inner roove wall (211) of the second inner fitting groove (21) respectively; and the outer groove wall (113) of the first inner fitting groove (11) and the outer groove wall (213) of the second inner fitting groove (21) are in linear contact with each other by elastic abutment where the outer groove wall (213) of the second inner fitting groove (21) and the outer groove wall (113) of the first inner fitting groove (11) are tangential with respect to each other;

alternatively, the outer groove wall (223) of the second outer fitting groove (22) is configured to have a reverse tapered shape; the outer groove wall (123) of the first outer fitting groove (12) and the outer groove wall (223) of the second outer fitting groove (22) are in surface contact with each other; as first outer press component (1131) and a second outer press component (2131) engaged with each other are provided on an inner side surface of the outer groove wall (113) of the first inner fitting groove (11) and an outer side surface of the outer groove wall (213) of the second inner fitting groove (21) respectively; and the inner groove wall (111) of the first inner fitting roove (11) and the inner groove wall (211) of the second inner fitting groove (21) are in linear contact with each other by elastic abutment where the inner groove wall (211) of the second inner fitting groove (21) and the inner groove wall (111) of the first inner fitting groove (11) are tangential with respect to each other;

further, in all the above five combinations of features, two seams (2231) that enable easy tearing are extended downwardly from a top end of the outer groove wall (223) of the second outer fitting groove (22); a portion of the outer groove wall (223) enclosed by the two seams (2231) defines a counterfeit tearable strip (2232); depths of the two seams (2231) are smaller than a thickness of the outer groove wall (223) of the second outer fitting groove (22).

2. The sealed packaging container of claim 1, wherein the extended periphery of the cover (1) forming as the first inner fitting groove (11) is first bent upwardly away from the bottom part of the body (2) to form the inner groove wall (111) of the first inner fitting groove (11), and then an upper end portion of the inner groove wall (111) of the first inner fitting groove (11) is bent outwardly to form a groove top (112) of the first inner fitting groove (11), and finally an outer end portion of the groove top (112) is bent downwardly to form the outer groove wall (113) of the first inner fitting groove (11) or an inner groove wall (121) of the first outer fitting groove (12); further, a bottom end of the outer groove wall (113) of the first inner fitting groove is further extended outwardly to form a groove bottom (122) of the first outer fitting groove (12), and an outer end of the groove bottom (122) of the first outer fitting groove (12) is further bent and extended upwardly away from the bottom part of the body (2) to form the outer groove wall (123) of the first outer fitting groove (12); the extended periphery of the body (2) forming as the second inner fitting groove (21) is first bent upwardly away from the bottom part of the body (2) to form the inner groove wall (211) of the second inner fitting groove (21), and then an upper end portion of the inner groove wall (211) of the second inner fitting groove (21) is bent outwardly to form a groove top (212) of the second inner fitting groove (21), and finally an outer end portion of the groove top (212) of the second inner fitting groove (21) is bent downwardly to form the outer groove wall (213) of the second inner fitting groove (21) or an inner groove wall (221) of the second outer fitting groove (22); further, a bottom end of the outer groove wall (213) of the second inner fitting groove (21) is further extended outwardly to form a groove bottom (222) of the second outer fitting groove (22), and an outer end of the groove bottom (222) of the second outer fitting groove (22) is further bent and extended upwardly away from the bottom part of the body (2) to form the outer groove wall (223) of the second outer fitting groove (22).

3. The sealed packaging container of claim 1, wherein the inner groove wall (111) of the first inner fitting groove (11), the inner groove wall (211) of the second inner fitting groove (21), the outer groove wall (113) of the first inner fitting groove (11), and the outer groove wall (213) of the second inner fitting groove (21), when being non-vertical, are tapered by 2 to 12 degrees.

4. The sealed packaging container of claim 1, wherein the first outer fitting groove (12) and/or the second inner fitting groove (21) is/are filled with solid tapered piece(s).

5. The sealed packaging container of claim 1, wherein the first outer fitting groove (12) is snap-fitted into the second outer fitting groove (22) by interference fit, and/or the second inner fitting groove (21) is snap-fitted into the first inner fitting groove (11) by interference fit.

6. The sealed packaging container of claim 1, wherein the seams (2231) are configured to extend down to a bottom end portion of the outer groove wall (223) of the second outer fitting groove (22), and the groove bottom (222) of the second outer fitting groove (22) is provided with a plurality of hollowed portions (2221) corresponding to the counterfeit tearable strip (2232); the hollowed portions (2221) define a plurality of connecting ribs (2222) connecting the counterfeit tearable strip (2232) and an inner groove wall (221) of the second outer fitting groove (22); each of the hollowed portions (2221) is sealed by being covered with a thin film (2223).

* * * * *